US005347914A

United States Patent [19]

Kinoshita et al.

[11] Patent Number: 5,347,914

[45] Date of Patent: Sep. 20, 1994

[54] TRAVERSE APPARATUS

[75] Inventors: Toshio Kinoshita; Youichi Nakamura, both of Katano; Kiyoshi Sawamura, Neyagawa; Tsutomu Yanagimoto, Fujiidera, all of Japan

[73] Assignee: Matsushita Electric Industrial Co., Ltd., Kadoma, Japan

[21] Appl. No.: 964,396

[22] Filed: Oct. 21, 1992

[30] Foreign Application Priority Data

Oct. 21, 1991 [JP] Japan ..... 3-272248

[51] Int. Cl.[5] ..... F01B 29/00

[52] U.S. Cl. ..... 92/88; 92/137; 91/361; 91/459; 277/DIG. 7

[58] Field of Search ..... 92/88, 137, 165 R; 91/459, 405, 361; 277/DIG. 7

[56] References Cited

U.S. PATENT DOCUMENTS

| | | | |
|---|---|---|---|
| 4,735,047 | 4/1988 | Wiedmann | 92/88 X |
| 4,856,415 | 8/1989 | Noda | 92/88 |
| 5,016,519 | 5/1991 | Goedecke et al. | 92/137 X |
| 5,088,382 | 2/1992 | Goedecke et al. | 92/137 X |
| 5,111,913 | 5/1992 | Granbom | 92/88 X |

FOREIGN PATENT DOCUMENTS

| | | | |
|---|---|---|---|
| 0029188 | 5/1981 | European Pat. Off. | 92/137 |
| 3176804 | 7/1988 | Japan | 92/88 |

*Primary Examiner*—Edward K. Look
*Assistant Examiner*—Hoang Nguyen
*Attorney, Agent, or Firm*—Ratner & Prestia

[57] ABSTRACT

The traverse apparatus of the subject invention is provided at the end of the main base 24 with a control box 38 having electromagnetic valves 57, 58, relief valves 59, 60, and manifold 61; and, one or more connectors 54 affixed at one end to sliding base 28 and at the other end to a separate sliding base 70. By these elements, the main body having cylinder 32 is separated from the rail guides 22, 23, the work of replacing a worn cylinder 32 is made easy, conveyance can be expedited, and the head mounting bases for attaching working heads can be increased readily.

2 Claims, 6 Drawing Sheets

TRAVERSE APPARATUS

BACKGROUND OF THE INVENTION in recent years traverse apparatus, as conveyinq devices capable of conveying at high speed light article to heavy articles and air driven, are used widely. In particular, the trend is for building block construction for those having higher speeds and long strokes.

Referring to the figures, an explanation is given below regarding prior art traverse apparatus.

As shown in FIGS. 11 through 13, the piston 1 moves to-and-fro in the direction shown by arrow A or by arrow B. The straight rail guide 3 is affixed by bolt 4 to a main body 2 having an orifice for driving piston 1. The steel belt 8 is fixed at both ends to end plate 9 and side plate 10. Packings 11, 12 to prevent air leakage and packings 13, 14 to prevent air leakage are respectively affixed to table 6 and connector 15. The pin 16, left in empty space, is there for controlling the volume of air in the ends when piston 1 moves to an end. In the FIGS., 18 and 19 are in and out ports for air, while 20 and 21 are air chambers.

The operation of a traverse apparatus configured as above will be described below.

First, when air is introduced to port 19, air will enter air chamber 20, the piston 1 will move in the direction shown by arrow A, and the table 6 affixed to piston 1 via coupler 15 is moved in the direction indicated by arrow A. In the same manner, if air is introduced to port 18, air will enter air chamber 21, piston 1 will move in the direction shown by arrow B and table 6 will move in the direction shown by arrow B.

Yet in the above prior art configuration, the following problems existed. To wit:

(1) The main body 2 contains apertures to drive piston 1 and also has rail guide 3, so that when the weight of the object being transported in the direction shown by arrow C in FIG. 13 came into play, the main body 2 will bend, the aperture for driving piston 1 will become warped and air leak will take place via the steel belt 8.

(2) When the aperture for driving piston 1 becomes worn and must be replaced, replacement must be made for each traverse apparatus, so that it becomes a replacement operation requiring the removal of the head (not shown) affixed to table 6.

(3) The procedure of stopping the table at the end portion of piston 1, intended to reduce the volume of air chamber 20 and increasing the pressure in air chamber 20 to use as back pressure, because the volume of air chamber 20 is reduced the pressure rise of the back pressure is slight, is unable to absorb the shock and it is not possible to move heavy objects or to increase the speed of movement.

(4) The main body 2 has but one piston 1, only one table 6 can be attached, and a plurality of tables cannot be attached.

An object of the subject invention is to solve the above noted prior art problems and present a traverse apparatus which, simplifies the replacement procedure with replacing a worn cylinder, is capable of high speed transport of objects to be moved, and for which head attachment bases can be added easily.

SUMMARY OF THE INVENTION

In order to achieve these objectives, the subject invention is a traverse apparatus, having; linear bearing contacting the main base at the rail guide to slide, a sliding base with affixed head attachment base for mounting the work head, a cylinder having a movable body affixed via a connector to the said sliding base, a detector mounted to the said main body base, and stopper bolts and shock absorbers mounted at both ends of the said main base, further having a control box at the end of the said main base, electromagnetic valves, relief valves and a manifold, The subject invention is also a traverse apparatus, having one or more connector affixed at one end to the sliding base and the other end affixed to a different sliding base.

In this configuration the main body having a cylinder, and the rail guide are separated and the rail guide is made independent. Also, by pressure being applied while the table is being moved via the relief valve to the back pressure side of the air within the cylinder, it serves to counter the inertia of the table and alleviate shock. Furthermore, by adding other tables to the rail guide which guides the table, any necessary number of tales can be connected by using connectors to couple the tables.

Perspective, partially exploded view of key portions of the traverse apparatus in the subject invention's first embodiment.

[FIG. 2]

Schematic of the key portions of the same traverse apparatus.

[FIG. 3]

Figure 1:
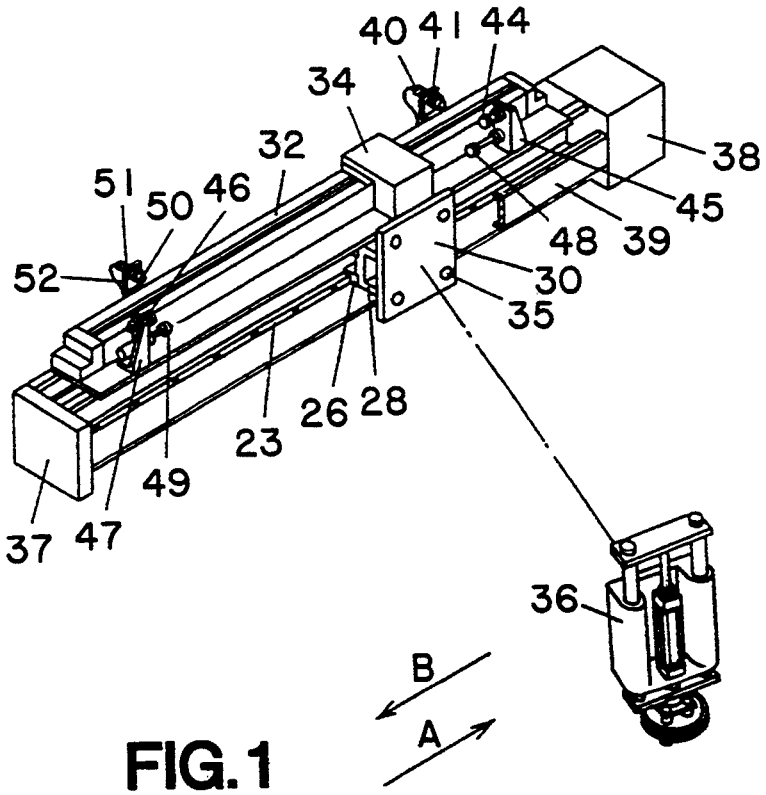
[FIG. 1]
Figure 2:
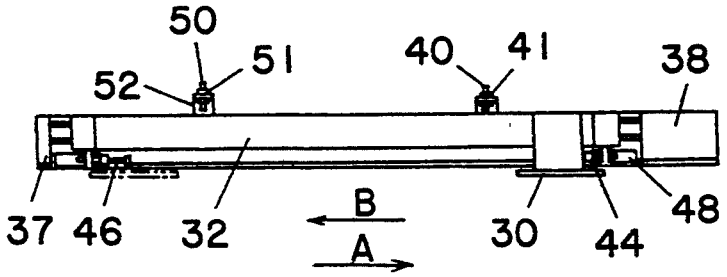
Figure 3:
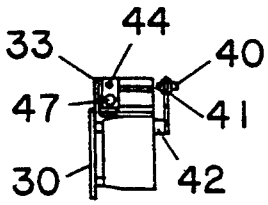

Side view of FIG. 2.

[FIG. 4]

Front view of FIG. 2.

[FIG. 5]

Figure 4:
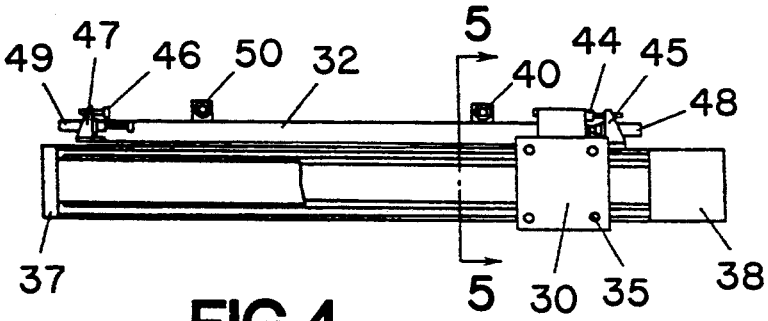
Figure 5:
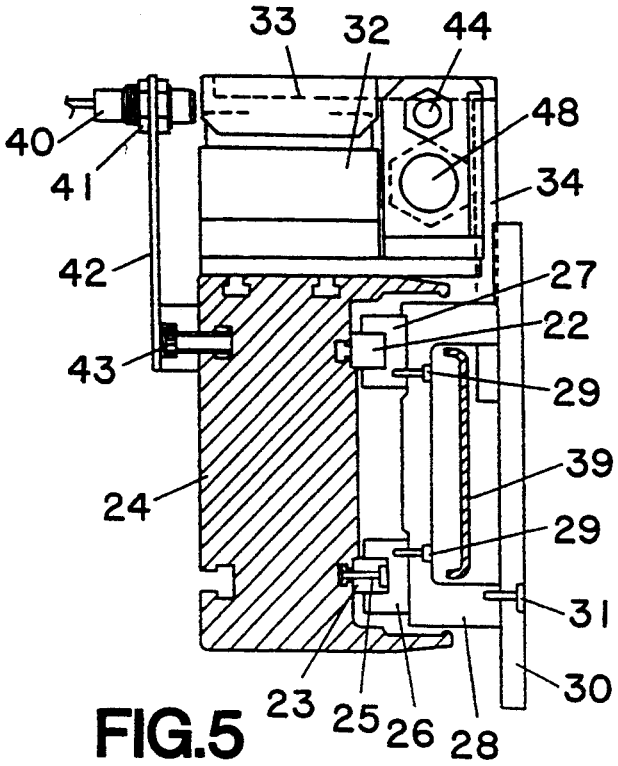
Figure 6:
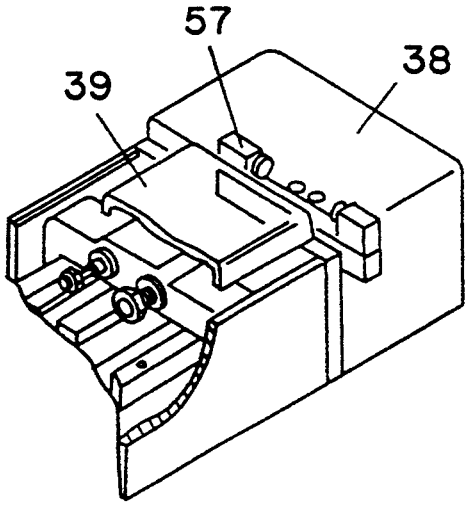
Figure 7:
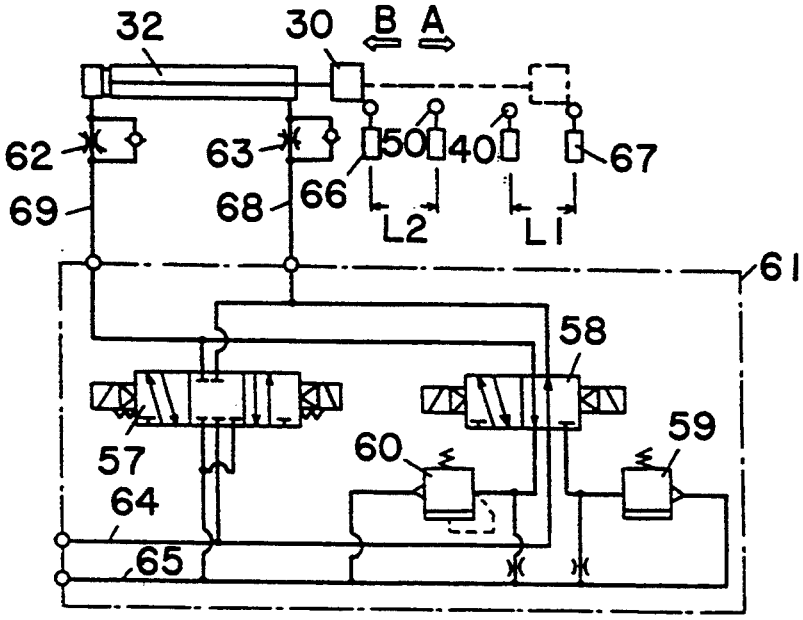

X-Y cross-section of FIG. 4.

[FIG. 6]

Perspective of the siting of the control box of the same traverse apparatus.

[FIG. 7]

Circuit diagram of the struction of the control box of the same traverse apparatus.

[FIG. 8]

Schematic of the control box of the same traverse apparatus.

[FIG. 9]

Figure 8:
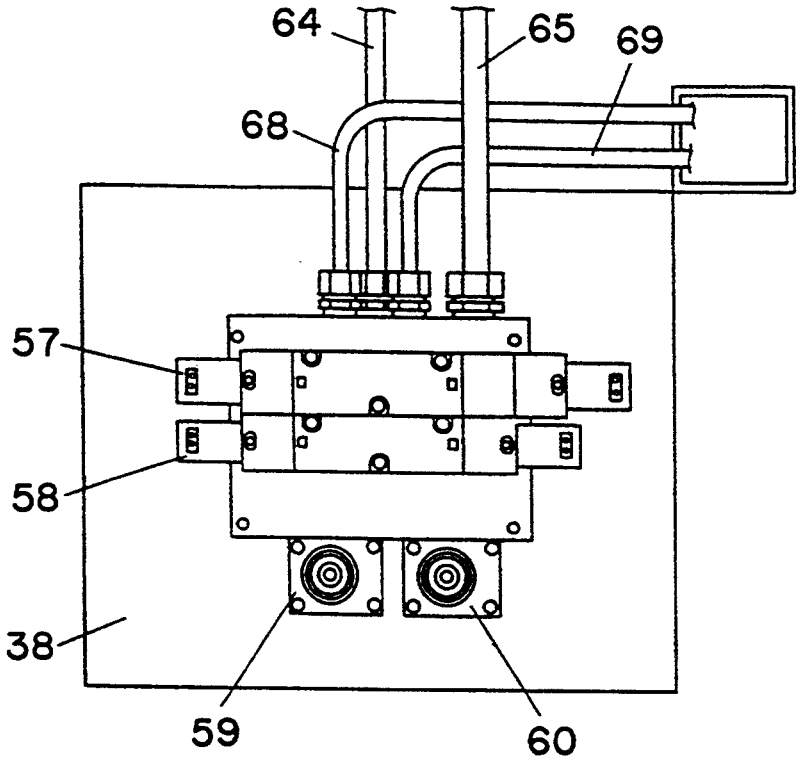
Figure 9:
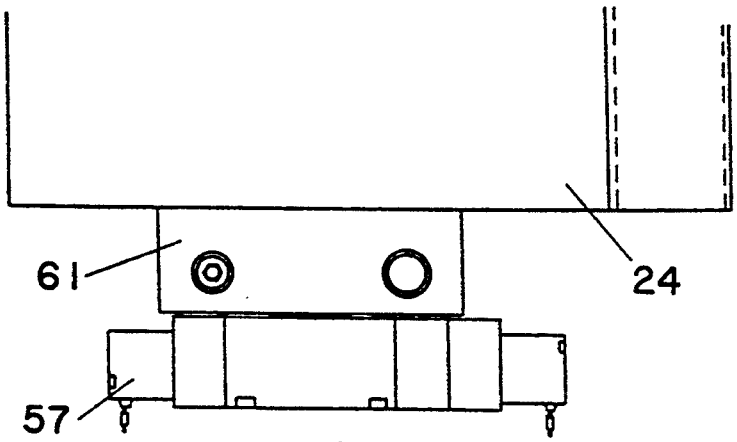

Side view of FIG. 8.

[FIG. 10]

Perspective of key portions of the traverse apparatus in a second embodiment of the subject invention.

[FIG. 11]

Perspective of prior art traverse apparatus.

[FIG. 12]

Frontal cross-section view of the key portions of the same traverse apparatus.

[FIG. 13]

Side cross-section view of the same traverse apparatus.

DETAILED DESCRIPTION OF THE INVENTION

The subject invention is related to traverse devices provided with head(s) to hold objects(s) and table(s) having head (s) .

The subject invention is a traverse apparatus having:

a main base, a sliding base with linear bearing contacting the rail guide and sliding there with affixed head attachment base for disposing working heads linear bearing, a cylinder having a movable body attached via a connecting panel to the said slide base, a detector disposed on the said main base, and, stopper bolts and shock absorbers disposed at both ends of the said main base, and further having a control box at the end of the said main base having an electromagnetic valve, a relief valve and a manifold.

The subject invention is also a traverse apparatus having one or more connectors affixed at one end to the sliding base and at the other end to a different sliding base.

In the subject invention, the main body having a cylinder is separated from the rail guide, and the rail guide is made independent. Also, since during movement of the table, pressure is applied via the relief valve to the back pressure side of the air in the cylinder, it serves to counter the inertia of the table and alleviates shock. Also, by adding other tables to the rail guide which guides the tables, and using connectors to couple the tables, any necessary number of tables can be connected. Thus, as a in the subject invention, the replacement process when exchanging worn cylinders becomes simple, objects to be moved can be transported at high speed, and, head attachment bases for attaching working heads can be easily added.

An explanation is given below, with reference to figures, of one embodiment of the subject invention.

As shown in FIG. 1 through FIG. 5, the rail guides 22, 23 are affixed to the main base 24 by bolt 25. Linear bearings 26, 27 are affixed to the sliding base 28 by bolt 29. Head attachment base 30 is affixed to the sliding base 28 by bolt 31. Cylinder 32 has movable body 33 affixed to the head attachment base 30 via connector plate 34. Working head 36 is attached to tap 35 disposed on head attachment base 30, 37 is a side panel attached to one end of the main base 24, 38 is the control box, 39 is a cover located inside the siding base 28 connecting the space between the side panel 37 and the control box 38. Proximity switch 40 is affixed to the attachment panel 42 via nut 41, 43 is a bolt affixing the attachment panel 42 to the main base 24. Stopper bolts 44 and 46 are respectively affixed to brackets 45 and 47. The shock absorbers 48 and 49, where the tip enters and leaves, are affixed respectively to brackets 45 and 47. Proximity switch 50 is affixed to attachment panel 52 via nut 51.

An explanation of the control box 38, which removes the stopping shock of the sliding base 28, is given below.

In FIG. 6 through FIG. 9, 57 is the main electromagnetic valve for driving, and 58 is the electromagnetic valve for low speed moving of the sliding base 28. 59 is the relief which operates in the PUSH direction of sliding base 30 as shown by arrow A and 60 is the relief valve which operates in the PULL direction of sliding base 30 as shown by arrow B. 61 is the manifold connecting the air channels of electromagnetic valve 57, electromagnetic valve 58, relief valve 59 and relief valve 60. Speed control 62 controls the cylinder 32's speed on the PULL side, while speed control 63 controls the speed of cylinder 32 on the PUSH side. 64 is the supply orifice for the air supply. 65 is the exhaust orifice for exhausting the air. 66 is the reed switch fitted at the end of cylinder 32's PULL side, and 67 is the reed switch fitted at the end of cylinder 32's PUSH side. 68 is the tube which supplies and exhausts the air at the PUSH side of cylinder 32, while 69 is the tube which supplies and exhausts the air at the PULL side of cylinder 32.

We shall now explain the cushioning operation of the control box 38, configurated as above.

While cylinder 32 is moved at high speed by electromagnetic valve 57, it assumes a blocking state when there is no current, and slow movement takes place due to electromagnetic valve 58. When actually operating (in case of PUSH), power is transmitted to electromagnetic valve 57 and electromagnetic valve 58 from the sequencer (not shown), and cylinder 32 is moved at high speed. When proximity switch 40 operates, the electromagnetic valve 57 cease to conduct. At this time, the air on the PUSH side of cylinder 32 has its pressure increased by the relief valve 59, located at the exhaust side of electromagnetic valve 58, and hinders the movement of cylinder 32. Due to this effect, cylinder 32 will stop smoothly. The distance L1 between the switch 67 and proximity switch becomes the cushioning stroke for cylinder 32's PUSH period. The distance L2 between proximity switch 50 and the reed switch 66 becomes the cushion stroke for cylinder 32's PULL period. By setting pressures for relief valves 59 and 60, the stopping time for cylinder 32 can be adjusted. Accordingly, the smooth stopping of cylinder 32 can be obtained by setting the pressures of relief valves 59 and 60.

Thus in this embodiment by affixing the cylinder 32 separately from the rail guides 22 and 23, when cylinder 32 is to be changed due to wear, all that is necessary is for cylinder 32 to be replaced. Also, since the sliding base 28 and rail guides 22 and 23 do not have to be removed, the work head 36 can be left as is, and time loss until restoration is small.

Further, by having a cushion to remove the shock of stopping, the exhaust pressure can be increased to hinder the movement of cylinder 32 and enable the smooth stopping of cylinder 32. By increasing the pressure in this manner, adjusting the proximity switches 40 and 50 which can be moved to any arbitrary position, and effectively making use of the cushion stroke, it is possible to achieve smooth stops with cushioned shock even with heavy loads or with loads having large weight differences.

Once again, since electromagnetic valves 57 and 58 are located at the ends of the traverse apparatus, operating adjustments of the traverse apparatus alone is possible so that its operation can be verified prior to its assembly into the manufacturing installation itself which permits in the adjustment and set up time of the manufacturing installation.

The second embodiment of the subject invention will be explained below, referring to the figures.

Figure 10:
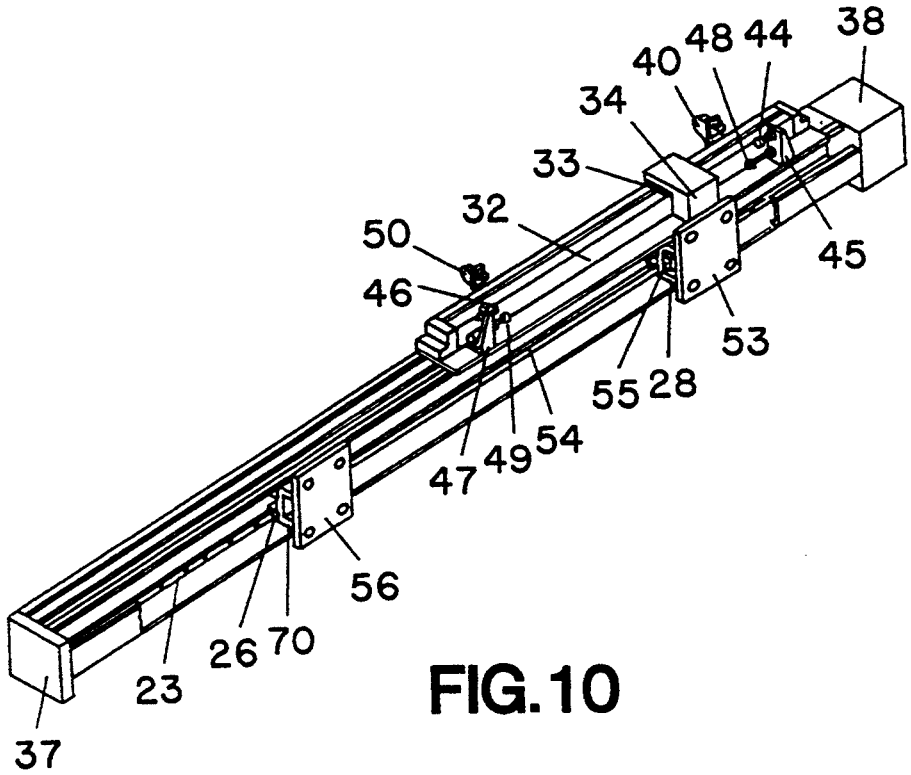
Figure 11:
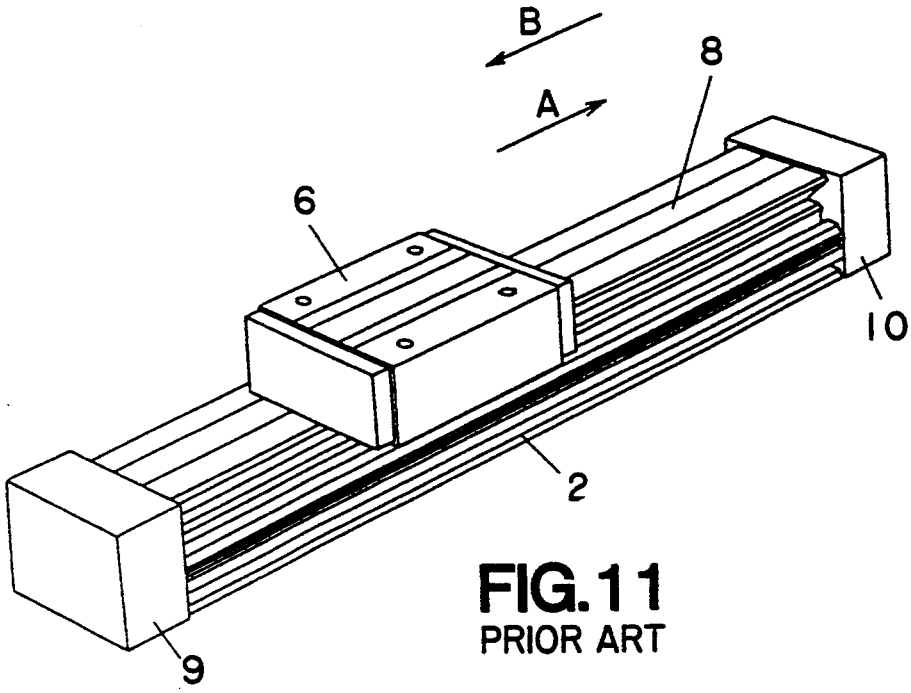
FIG. 11 PRIOR ART
Figure 12:
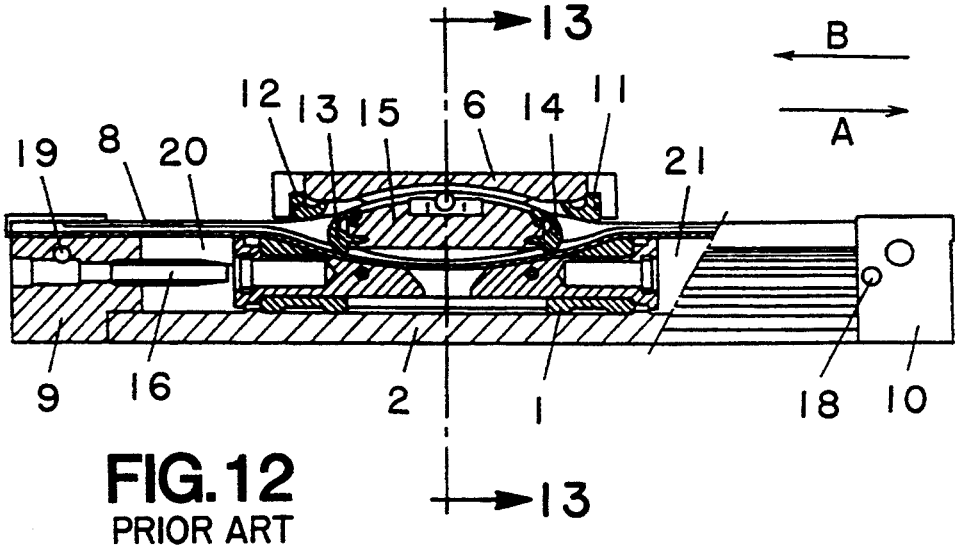
FIG. 12 PRIOR ART
Figure 13:
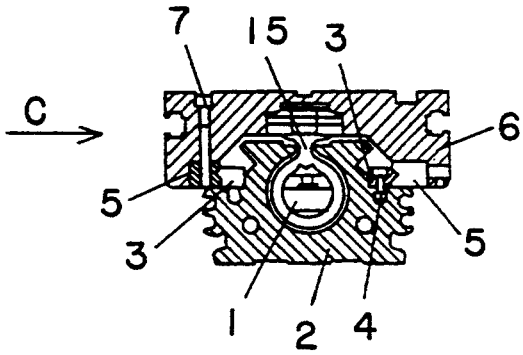
FIG. 13 PRIOR ART

The differences from the first embodiment explained with FIG. 1 through FIG. 9, are that, as shown in FIG. 10, one end of the connector 54 is affixed by screw 55 to the sliding base 28 of the head attachment base 53, affixed via connecting plate 34 to the movable body 33, and the other end of the connector 54 is affixed by a screw (not shown) to the sliding base 70 of the head attachment base 56.

The addition of head attachment bases, in the same manner as related above, can be done by increasing the number of connectors 54.

As related above, the number of sliding bases can be set arbitarily by adding connectors 54 and operating heads can be increased and operation positions can be set to plurality of locations, thus various operations are possible at the stopping positions of the sliding bases.

Also, since a plurality of sliding bases can be operated with one cylinder 32, the cost of the facility can also be reduced.

As it is clear also from the above explanation of embodiments that the subject invention realizes a superior traverse apparatus; having a structure of a main base, a sliding base, a cylinder, a detector, stopper bolts, shock absorbers and a control box at the end of the main base having electromagnetic valves, relief valves and a manifold; also having one or more connectors affixed at one end to the sliding base and the other end to a different sliding base, enabling simple replacement of worn cylinders, and capable of high speed transport of traversing items, and further capable of simply adding head attachment bases to attach working heads.

What is claimed is:

1. A traverse apparatus comprising:

a main base having an end;

a rail guide affixed to said main base;

a sliding base having a linear bearing which slides while contacting said rail guide;

a head mounting base affixed to said sliding base for disposing a working hear;

a cylinder, arranged separately of said rail guide, having a movable body connected to said sliding base via a connecting panel;

a detector disposed on said main base;

stopper bolts and shock absorbers disposed at both ends of said main base; and a control box, located at said end of said main base, said control box having electromagnetic valves, relief valves and a manifold.

2. A traverse apparatus, as claimed in claim 1, further comprising one or more connectors each having a first end and a second end, said first end affixed to a sliding base and said second end affixed to another sliding base.

* * * * *

UNITED STATES PATENT AND TRADEMARK OFFICE

CERTIFICATE OF CORRECTION

PATENT NO. : 5,347,914
DATED : September 20, 1994
INVENTOR(S) : Kinoshita et al.

It is certified that error appears in the above-identified patent and that said Letters Patent is hereby corrected as shown below:

Claim 1, Col. 6, line 5, delete "hear" and insert --head--.

Signed and Sealed this

Fourteenth Day of February, 1995

*Attest:*

Bruce Lehman

BRUCE LEHMAN

*Attesting Officer*

*Commissioner of Patents and Trademarks*